US007219473B2

(12) United States Patent
Mantyla et al.

(10) Patent No.: US 7,219,473 B2
(45) Date of Patent: May 22, 2007

(54) RIDGE VENT APPARATUS

(75) Inventors: James Mantyla, Barrie (CA); James H. A. McKee, Barrie (CA); Rick Parkinson, Barrie (CA); Nicholas Broeders, Innisfil (CA)

(73) Assignee: Canplas Industries Ltd., Barrie, Ontario (CA)

( * ) Notice: Subject to any disclaimer, the term of this patent is extended or adjusted under 35 U.S.C. 154(b) by 231 days.

(21) Appl. No.: 11/085,435

(22) Filed: Mar. 21, 2005
(Under 37 CFR 1.47)

(65) Prior Publication Data

US 2006/0196130 A1 Sep. 7, 2006

(30) Foreign Application Priority Data

Mar. 7, 2005 (CA) ..... 249957

(51) Int. Cl.
*E04B 7/00* (2006.01)
*E04H 12/28* (2006.01)

(52) U.S. Cl. ..... 52/198; 52/95; 454/366; 454/250; 454/260

(58) Field of Classification Search ..... 52/57, 52/95, 198, 199; 454/364, 366, 250, 260
See application file for complete search history.

(56) References Cited

U.S. PATENT DOCUMENTS

| | | | |
|---|---|---|---|
| 2,214,183 | A | 9/1940 | Seymour |
| 2,799,214 | A | 7/1957 | Roose |
| 2,868,104 | A | 1/1959 | Honholt et al. |
| 3,236,170 | A | 2/1966 | Meyer et al. |
| 3,481,263 | A | 12/1969 | Belden |
| 3,625,134 | A | 12/1971 | Smith |
| 3,660,955 | A | 5/1972 | Simon |
| 3,949,657 | A | 4/1976 | Sells |
| 4,073,106 | A | 2/1978 | Malott |
| 4,080,083 | A | 3/1978 | Malott |
| 4,280,399 | A | 7/1981 | Cunning |
| 4,325,290 | A | 4/1982 | Wolfert |
| 4,484,424 | A | 11/1984 | Logsdon |
| 4,520,713 | A | 6/1985 | Arfsten |
| 4,550,648 | A | 11/1985 | Eagle |
| 4,554,862 | A | 11/1985 | Wolfert |
| 4,555,982 | A | 12/1985 | Goubaud |

(Continued)

*Primary Examiner*—Naoko Slack
*Assistant Examiner*—Chi Q. Nguyen
(74) *Attorney, Agent, or Firm*—Hoffmann & Baron, LLP

(57) ABSTRACT

A ridge ventilator for covering an open ridge of a roof while promoting ventilation of a space beneath the roof. The ridge ventilator has a sectional body having a first side and a second side, a number of partitions extending across said body between said sides, as well as a first end and a second end. The vent body has a width between said sides to permit said body to be laid over and cover an open ridge in a roof formed at the peak. The body also includes a recessed middle portion in a top face of the body, the recess being sized and shaped to accommodate roofing cap shingles. The body also includes opposed raised and curved, in side view, air foil side sections; which have a grill to permit air to pass therethrough between a space beneath said roof and the outside, the air foil side sections being sized and shaped to create, in a wind passing over the air foil sections, a low pressure adjacent to the grill to facilitate drawing air out of the space.

17 Claims, 4 Drawing Sheets

U.S. PATENT DOCUMENTS 4,607,566 A 8/1986 Bottomore et al.
4,643,080 A 2/1987 Trostle et al.
4,676,147 A 6/1987 Mankowski
4,782,743 A 11/1988 Quinnell
4,817,506 A 4/1989 Cashman
4,843,953 A 7/1989 Sells
4,899,505 A 2/1990 Williamson et al.
4,903,445 A 2/1990 Mankowski
4,907,499 A 3/1990 James
4,924,761 A 5/1990 MacLeod et al.
4,957,037 A 9/1990 Tubbesing et al.
5,009,149 A 4/1991 MacLeod et al.
5,035,172 A 7/1991 Waggoner
5,050,489 A 9/1991 Mankowski
5,052,286 A 10/1991 Tubbesing et al.
5,054,254 A 10/1991 Sells
5,060,431 A 10/1991 MacLeod et al.
5,070,771 A 12/1991 Mankowski
5,081,914 A 1/1992 Mejia
5,092,225 A 3/1992 Sells
5,095,810 A 3/1992 Robinson
5,112,278 A 5/1992 Roberts
5,122,095 A 6/1992 Wolfert
5,149,301 A 9/1992 Gates
5,167,579 A 12/1992 Rotter
5,197,921 A 3/1993 De Lank et al.
D336,952 S 6/1993 Raneo
5,304,095 A 4/1994 Morris
5,331,783 A 7/1994 Kasner et al.
5,339,582 A 8/1994 Sells
5,355,644 A 10/1994 Guhl et al.
5,425,672 A 6/1995 Rotter
5,457,920 A 10/1995 Waltz
5,458,538 A 10/1995 MacLeod et al.
5,487,247 A 1/1996 Pigg
5,498,205 A 3/1996 Knowles et al.
5,535,558 A * 7/1996 Rieke et al. ..... 52/199
5,549,513 A 8/1996 Thomas et al.
5,600,928 A 2/1997 Hess et al.
5,630,752 A 5/1997 Gubash
5,655,964 A 8/1997 Rheault et al.
5,704,834 A 1/1998 Sells
5,738,581 A 4/1998 Rickert et al.
5,749,780 A 5/1998 Harder et al.
5,772,502 A 6/1998 Smith
5,826,383 A * 10/1998 Garrison ..... 52/198
5,860,256 A 1/1999 Humber
5,867,956 A 2/1999 Gregory, Jr. et al.
5,960,595 A 10/1999 McCorsley, III et al.
5,971,848 A 10/1999 Nair et al.
6,125,602 A 10/2000 Freiborg et al.
6,149,517 A 11/2000 Hansen
6,227,963 B1 5/2001 Headrick
6,233,887 B1 5/2001 Smith
6,260,315 B1 7/2001 Smith
6,263,630 B1 7/2001 Bennett
6,277,024 B1 8/2001 Coulton
6,298,613 B1 10/2001 Coulton et al.
6,299,528 B1 10/2001 Hansen
6,308,472 B1 10/2001 Coulton et al.
6,371,847 B2 4/2002 Headrick
2001/0019941 A1 9/2001 Headrick

* cited by examiner

RIDGE VENT APPARATUS

CROSS-REFERENCE TO RELATED APPLICATIONS

This application claim the benefit of Canadian Application No. 2,499,557, titled "Ridge Vent Apparatus", filed Mar. 7, 2005, the contents of which is incorporated herein by reference.

FIELD OF THE INVENTION

This invention relates generally to passive ventilators and more particularly to passive ventilators of the type that may be placed over openings in a roof of a building. Most particularly, this invention relates to a ridge type of vent which may be used to cover an opening along a ridge of a roof, for example.

BACKGROUND OF THE INVENTION

Attic spaces in buildings, such as residential buildings, require ventilation. Often the attic space needs to be ventilated to prevent the buildup of moisture or the like. There are many types of active and passive ventilation devices for ventilating such attic spaces of such buildings. Roof vents may be placed in an opening in a roof to permit air to pass out from beneath the roof through the roof vent to the outside. The roof vent may be passive, having no moving parts, or, it may be an active vent including fans, ventilators or the like.

One form of vent that has been found to be particularly effective is a ridge vent. Hot air rises relative to cold air. An opening provided along a ridge or peak of a building provides an opportunity for hot air to escape from the top of an enclosed space, ensuring a full circulation of air through the space. However, an open ridge permits rain, snow and pests to enter into the space. Therefore, some means is required to cover the ridge opening. Many types of ridge vents have been proposed in the past. While having certain advantages, they also have disadvantages by being expensive, awkward to use or install and having uncertain effectiveness in drawing air out of the building enclosure.

One example of a prior ridge vent is shown in U.S. Pat. Nos. 6,227,963 and 6,371,847 to Headrick. In these patents, a ridge vent is shown with an upstanding wind baffle formed at the outer edge of the vent to create turbulence to draw air through the grills of the vent. The grills are on a side surface, and face an upstanding baffle, forming a trough therebetween. In colder climates, where precipitation can freeze in the form of snow or ice, such a trough is not practical, as it can fill up with snow or ice thereby blocking the vents and causing a failure in air circulation. Therefore, some other configuration of elements is required.

What is required is an improved ridge vent to facilitate drawing air from within the building enclosure to an outside of the enclosure, which works in northern and southern climates.

SUMMARY OF THE INVENTION

What is desired is a simple to use ridge vent that is most preferably form from molded plastic so it may be made in large numbers at low cost. The vent is most preferably sectional and can be used on roof peaks of various lengths and adaptable to roof peaks of various slopes. The sections should be easy to join end to end and easy to align to ensure proper orientation on the roof peak by the installer.

There is also a need for a vent structure which is attractive and yet is efficient at drawing out air from the inside to the outside. The vent should be somewhat discrete so as not to be too noticeable by for example being covered with standard roof shingles. In such a case the roof vent should be easy to use for both metric and imperial sized roof shingles. Most preferable the roof vent is adaptable to accommodate a standard shingle peak cap or row of shingles.

Therefore according to one aspect of the present invention there is provided a ridge ventilator for covering an open ridge of a roof while promoting ventilation of a space beneath the roof, the ridge ventilator comprising:

- a sectional body having a first side and a second side, a plurality of partitions extending across said body between said sides, and a first end and a second end;
- a width between said sides to permit said body to be laid over and cover said open ridge in said roof;
- a recessed middle portion in a top of said body, between said sides, said recess being sized and shaped to accommodate roofing shingles;
- opposed raised and curved, in side view, air foil side sections; said air foil side sections including a grill to permit air to pass therethrough between said space beneath said roof and the outside, said air foil side sections being sized and shaped to create, in a wind passing over said air foil sections, a low pressure adjacent to said grill to facilitate drawing air out of said space.

According to a further aspect of the invention the roof vent is comprised of a plurality of identical sections which can be joined end to end, regardless of which end is first secured to align after placed sections along the ridge. The vent sections can be trimmed to a convenient length without exposing an open end through which precipitation or pests may pass. These and other aspects will be further understood from the detailed description below.

BRIEF DESCRIPTION OF THE DRAWINGS

Reference will now be made to drawings of preferred embodiments of the present invention, by way of example only, in which.

DETAILED DESCRIPTION OF THE PREFERRED EMBODIMENTS

Figure 1:
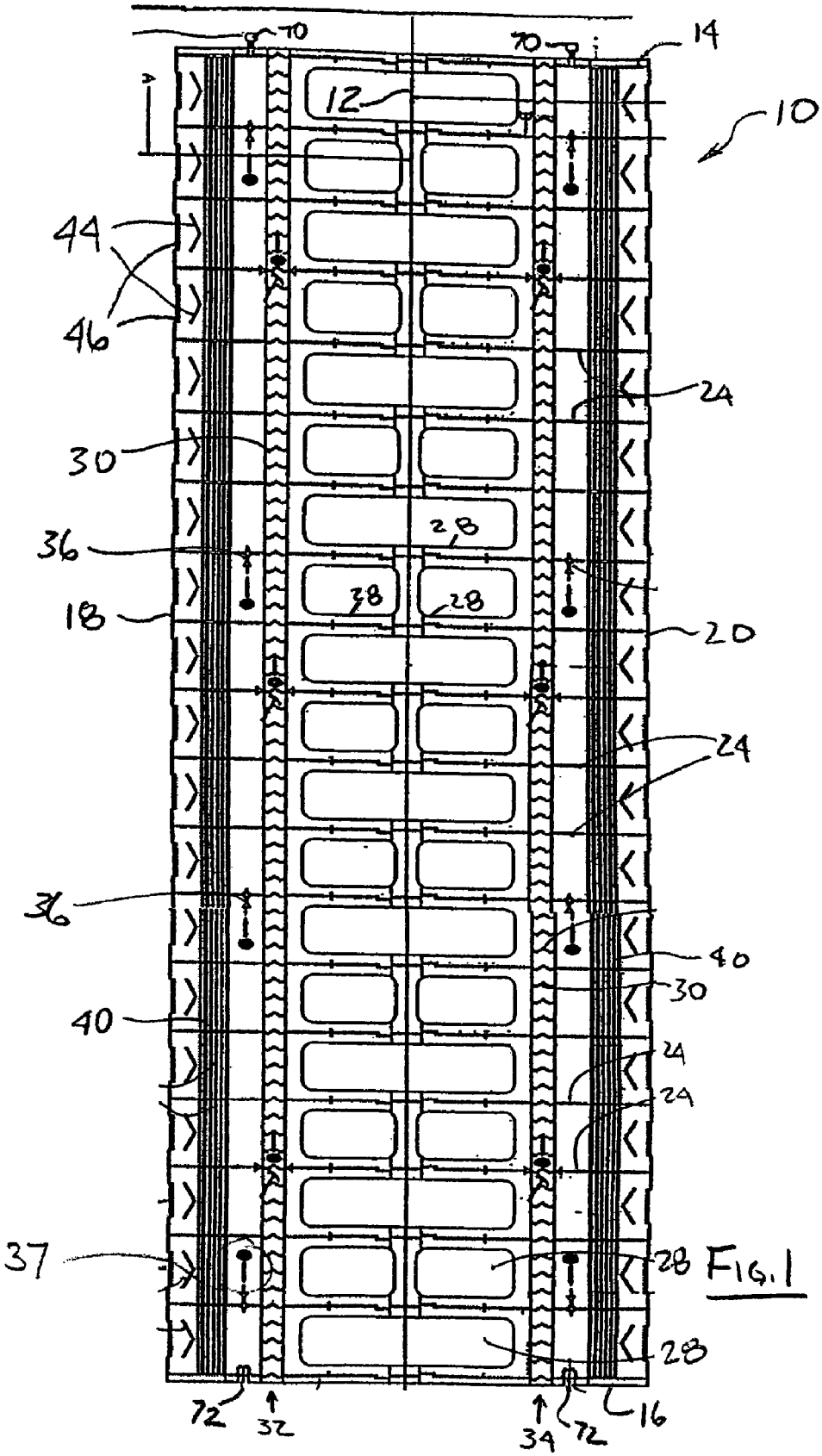
FIG. 1 is a view from below of a ridge vent according to the present invention.

FIG. 1 is a view from below of a section 10 ridge vent according to the present invention. The ridge vent section includes a central axis 12, a first end 14, a second end 16 and sides 18 and 20.

A plurality of partitions 24 which are generally parallel, extend between the sides 16 and 18. At the first and second ends, the partitions 24 form end walls to the ridge vent. The partitions are evenly spaced and help support the web of the ridge vent above the plane of the roof. In this manner, air may pass underneath the ridge vent from the inside of a building to the outside. This is explained in more detail below.

Also shown in FIG. 1 are material saving openings 28 which reduce the total amount of molded plastic required. These openings also minimize bulging or building due to thermal expansion. Extra web support is provided in the shape of waved columns 30 extend along two rows 32 and 34 on either side of the material saving openings 28. These rows are positioned laterally to permit shingles, over mounted on the section 10 of the vent, to be nailed through the vent into the underlying roof. These rows of columns therefore define nailing strips or rows.

Although wave-shaped columns are shown, other shapes of columns could also be used without departing from the scope of the present invention. All that is required is that enough support be provided so that the portion of the ridge vent extending across the opening is supported above the roof to permit air to pass up through the ridge opening, under the ridge vent section past the columns and then out to the outside. Nailing points 36 are also preferred which provides specific support to a nail passing through the ridge vent and into the underlying roof at specific locations. Most preferably the nailing supports are in the form of a cylinder through which the nail passes. The roof vent may include surface markings to show the installer where to place the nails as shown at 37.

Lateral vents 40 are also shown. The lateral vents 40 are most preferably in the form of overlapped slats which form a moulded in grill. Preferably the grill slats are spaced sufficiently close to prevent pests and the like from passing through the grill, and angled in a way to direct precipitation away from the opening in the roof peak when the vent is placed in position over a roof peak.

As can be seen, a V-shaped angled baffle 44 is provided on the underside of the vent, adjacent to the sides 16, 18 in each partition section of the roof vent 10. The angled baffle 44 is associated with a drainage opening 46 in each partition section. The angled baffle 44 prevents precipitation, driven up through drainage opening 46 by wind or the like from passing further up the roof towards the ridge opening.

Figure 2:
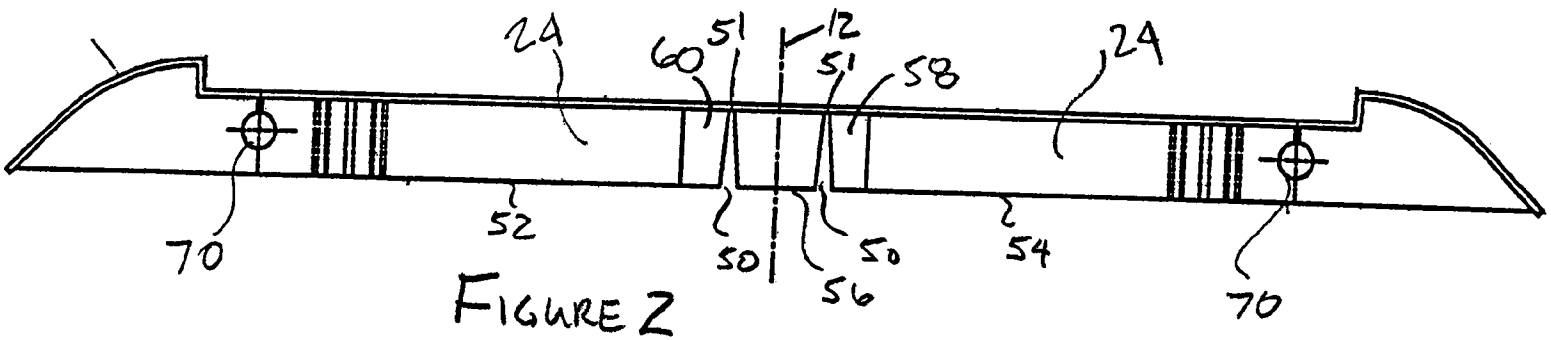
FIG. 2 is an end view of the roof vent of FIG. 1.

Turning now to FIG. 2, an end view of the roof vent 10 is shown. It can now be appreciated that each partition 24 is formed with at least one, and most preferably two notches 50. The notches 50 define a pair of opposed partition walls 52 and 54 separated by a central tab 56. The ends of the partition walls 52, 54 include slightly displaced portions 58 and 60. The displaced portions 58 and 60 are displaced laterally by the thickness of the central tab 56, to permit the partition walls to overlap the central tab without interference, but closely spaced when the sides 16 and 18 are bent towards one another as the section 10 is secured on a roof ridge or peak. In this manner the vent is made easily bendable over a ridge because the partition walls do not interfere with the tabs.

As can be seen in FIG. 2, the two notches 50 define two bending axes 51 about which the roof vent may be bent. This permits the roof vent to easily confirm a variety of angles of roof peak, even relatively steep angles such as 14/12. Two bending lines are formed, at the intersection points of the central tab and the two partition walls, i.e. at the bottom of the notches 50. To help the bending at this point, the present invention comprehends adding score lines or lines of weakness formed into the plastic, which act as a living hinge along the axis. The roof vent section forms a truncated pyramid when bent, which facilitates placing the roof vent in position on a roof ridge over an opening. The central tab has a base of a predetermined length, preferably between about ½ inch to 1½ inches, most preferably about 1 inch. This dimension has been found to produce good bending results in bending the roof vent over the roof peak.

Also shown are end attachment knobs 70 which fit into recesses 72 (shown in FIGS. 1 and 3) to connect ridge vent sections together. Due to the rectangular nature of the vent sections, assuming that the first vent is set square on the ridge, the remaining vent sections extending along the ridge will also be set simply by being mounted into the attachment knobs of the previous section. Thus, the attachment knobs and mating openings also function as an alignment means according to the present invention.

A further feature of the attachment knobs and slots of the present invention is that they may be connected together whether the male portion or the female portion is already nailed to the roof. This ability arises because the male and female positions of the attachment means are sized and shaped to permit this increased functionality. In particular, the female portion is a slot having an open top and bottom, permitting the male portion to be inserted from above or below. Detents are formed in the slot to hold the male portion vertically in position. The detents act on the narrower shaft behind the head portion. The female portion is a t-shaped slot with the larger head of the male portion being axially secured in the top of the T. In this way, the male portion is secured axially, and vertically, and with two male/female attachments on each end of any given vent section 10, the attachment means also acts as an alignment means to align adjacent sections along the ridge peak. Further, because the female portion is open at both the top and the bottom faces, the male part may be placed in the female part even if the latter is already secured to a roof peak or the female part may be placed over a male part if the latter is already secured to a roof peak. In this way the vent sections of the present invention are easy to install as it is not necessary to start in any particular direction to secure adjacent sections to ones already installed.

An advantage of the present invention can now be more clearly understood. Ridge openings come in various lengths according to the length of the roof peaks in which they are formed. Therefore, there is a need for a ridge vent which is easily adapted to suit the particular length of ridge opening to be covered. The present invention is preferably formed from moulded plastic, and while durable and resistant to degradation by the elements, the plastic is sufficiently soft that it can be easily cut with a sharp utility knife or saw. To size the present invention to a ridge opening of a particular length, all that is required is to place the ridge vent sections end to end until the end of the last ridge vent section extends beyond the end of the ridge opening. Then, a utility knife or saw can be used to trim the over hanging ridge vent section to the closest partition wall 24 to suit the ridge opening. According to the present invention the overlapping portions of the partition walls are sized and shaped to close the notches 50 when the vent is bent over the minimum roof peak angle for which the vent is sized. In this way the partition wall forms an essentially continuous end wall, when bent over a peak. If the peak is on a roof having a larger slope than the minimum design slope the partition wall simply overlaps the central tab by reason of the offset discussed previously. Thus, the plurality of parallel partition walls permits the present invention to be easily sized to accommodate ridge openings of different lengths and provides a closed end wall close to where it is needed.

A spacing of about 2½ inches or about 6 cm between partition walls has been found to give adequate results, although other spacings could also be used. What is required is a spacing which is close enough to be practical to trim to fit. The closer the spacing the better the fit that can be made. Also, the vent can be provided in either standard metric unit sizes or imperial unit sizes to facilitate use on a building made to either metric or imperial standards. Further other configurations of partition walls and notches can be used, provided that a continuous end wall is provided over the design range of bending angles corresponding the peak angles onto which the vent is to be placed and the continuous wall so formed does not prevent the vent from being easily bent over the peak.

Figure 3:
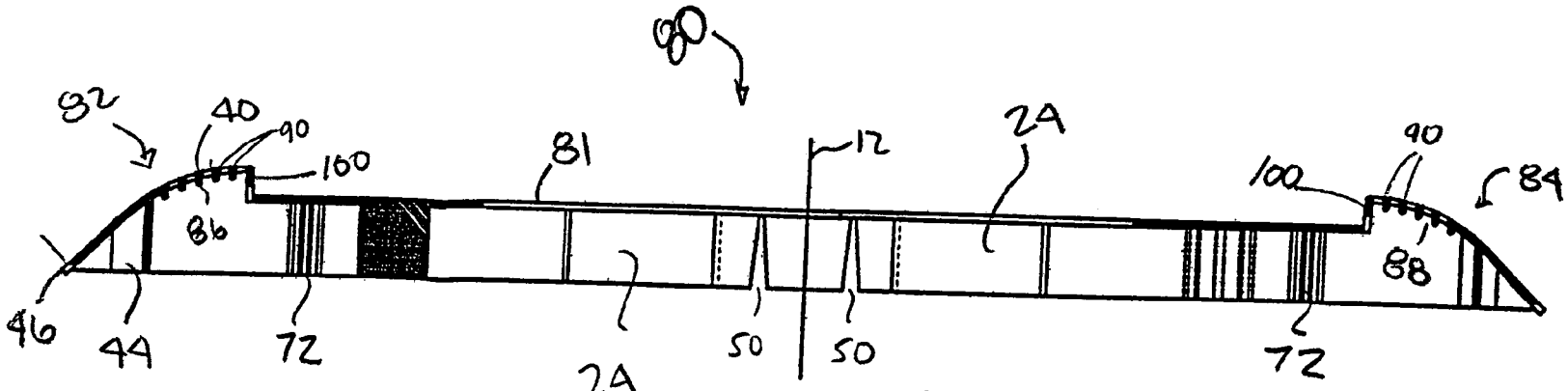
FIG. 3 is a cross sectional; view along lines 3—3 of the roof vent of FIG. 1.

Turning now to FIG. 3, a cross section of the ridge vent is shown. As can be seen, the top side 80 of the ridge vent includes a number of distinct features. The first distinct feature is a lower central portion 81 which is generally flat. Ideally, the width of the lower central portion 81 is sufficient to permit a standard roofing shingle to be laid therein to form a ridge cap when the vent is installed in position over a roof peak. In this way, the material saving openings 28 can be covered by shingles in the form of a conventional ridge cap as shown in the drawings and rain, precipitation and the like is prevented therefore from entering into the ridge opening building though these openings in the vent section 10. Most preferably, the width of the recessed central portion 81 is 11½ inches to accommodate a standard imperial shingle. This width can also be about 33 cm. to accommodate a standard metric shingle. It will be further appreciated that the width of the recessed central portion is made slightly shorter than the actual width of the cap shingle section. As can now be understood, when the section of the present invention are installed over a peak, the roof vent will be generally V-shaped. The cap shingle sections, nailed into the central recessed portion, will be rounded, and thus will seem shorter when bent. Thus, the present invention provides for a slightly smaller width, when flat, of central recessed portion 81 than the flat width of the shingle. The smaller width of the central recessed portion is preferably less than 5% of the total width of the cap shingle section and most preferably less than about 2%. In this way, the cap shingle sections can extend to the edge over a range of angles of roof peaks, without coming up short, at the sides of the central recessed portion.

Also shown are air foil sections 82 and 84 on either lateral edge of the vent 10. The air foil sections 82 and 84 include grills 86, 88 having a plurality of slats 90. As previously indicated, the slats 90 are oriented at an angle to deflect precipitation downwardly onto the roof below these sections and away from the ridge opening but at the same time to permit air to circulate out through the grills from within the building enclosure. Precipitation which enters the slats is urged, by gravity, past the angled baffle 44 and out the drainage opening 46. It will now be appreciated that in the installed position, the air foil sections 82 and 84 will extend past the side edges of the ridge opening and will overlie roof sections which are otherwise shingled to protect the underlying structure against water damage (see FIG. 4). Thus, precipitation passing into the vent at these air-foil sections will land on a shingled roof surface to be removed by gravity down towards the eves of the roof.

A further feature of the present invention is grill openings 100 which are provided in the vertical side walls of the air foil sections 82 and 84. These grilled openings permit precipitation landing on the shingles to drain out of the lower central portion 80, into the air foil sections, then underneath the air foil sections on the underlying shingled roof, out through the drain drainage opening and down to the eves. In this manner, precipitation is controlled to prevent it from entering the ridge opening, and from building up in the lower central portion. The grilled openings also promote air removal, as explained below.

Figure 4:
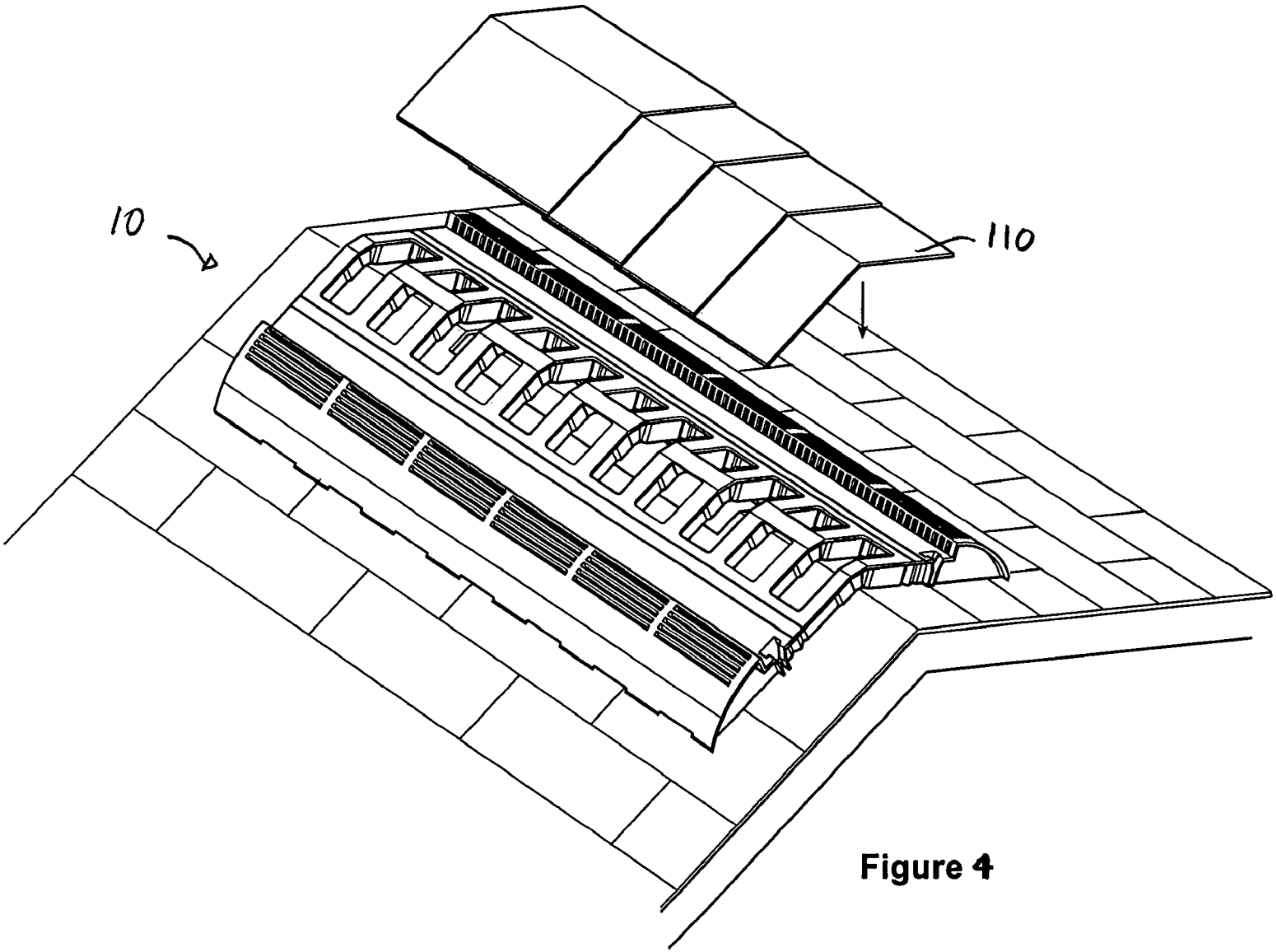
FIG. 4 is a perspective view of the roof vent of FIG. 1 in place over a roof ridge, showing the manner of installation.

FIG. 4 shows the ridge vent in an installed position. It will be noted that shingles 110 have been lain in the central region and the roof vent section 10 has been bent over a roof peak and secured in place by means of nails through nailing supports described above.

Figure 5:
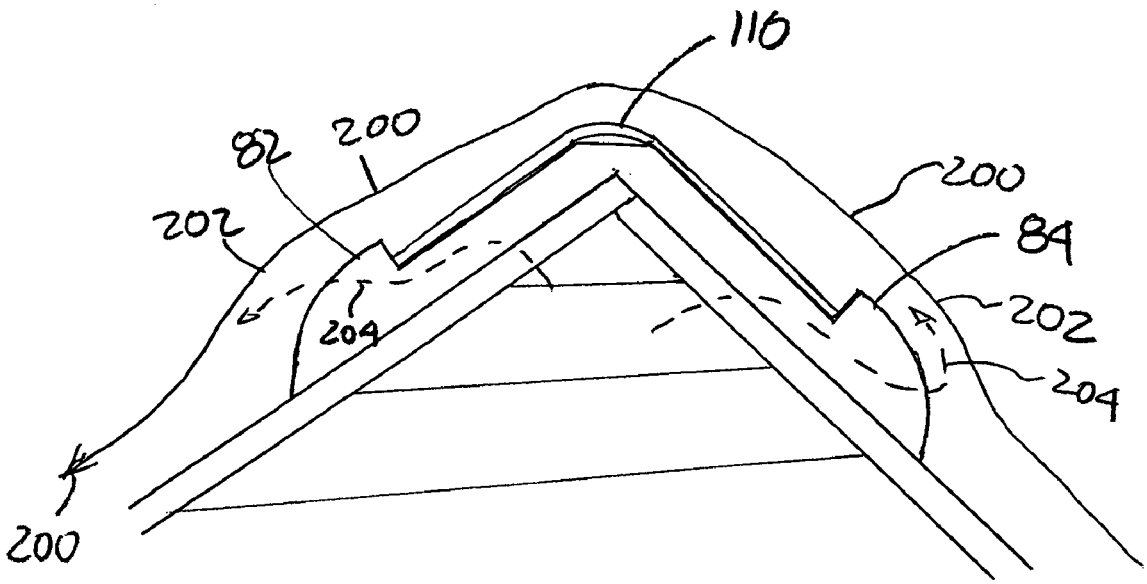
FIG. 5 is a side view of the installed roof vent showing the air foil effect of the curved side portions.

Another advantage of the present invention can now be understood from FIG. 5. It will be appreciated that the rounded air foil sections of the present invention will create a wing like affect in the event of a wind 200 passing over the air foil sections. As the wind passes over the rounded section 202, it will tend to accelerate in a laminar flow manner, causing a low pressure to facilitate drawing air 204 out of the attic or building enclosure according to Bernoulli's law. This air foil effect assists the operation of the passive roof vent in turning over air in the building enclosure. By having the central portion lower, the air foil sections stand proud of the features of the roof, enhancing the air removal efficiency. In particular, the end walls having built in grill portions are exposed to passing air, and permit the air to inflow through the vertical wall, and then out the grill sections. This air is useful to drag other air out of the building enclosure, and increases the efficiency of the air change over. Thus, not only does the present invention provide a low pressure on the unused side, it permits the air stream to divide into two, one over the air foil section and another through the air foil section to set up good circulation.

The method of installing the present invention can now be described. First the roof will be shingled in a conventional manner up to the edge of the opening in the roof peak. Then a first section of the roof vent is carefully positioned at one edge of the roof peak opening and the installer checks to ensure that the vent can bend over the opening and on top of the shingled roof on either side. It is important to ensure that the vent extends down the peak enough, or that the underlying shingles extend up the peak enough that the vent overlaps the shingled surface on both faces of the roof peak.—Once it is carefully aligned, then it is nailed to the roof through the tubular nailing supports which both bends it over the peak and holds the vent section in place. It will be noted that the vent securing nails are positioned in the central recessed portion 81 in a position where the ridge cap shingles will cover the nail heads to prevent leaks at those locations.

The next step is to install the net adjacent section which can be placed in to the male female attachment means, as previously described, pressed down on the roof and also nailed into place. This sequence is repeated until the last section overlaps the end of the ridge opening and then the last section is trimmed to an appropriate length.

The next step is to place the ridge cap in the recessed portion 81 by starting at one end and laying in the shingles in an overlapping manner as is usually done. The shingle nails will be underneath the next overlapping shingles to prevent leaks as is conventional for such shingles. In this case the shingle nails will be driven through the vent sections in the nailing row, where the extra support columns are provided. The cap row of shingles is then extended fully along the ridge, and the installation is then finished.

Although the present invention has been described with respect to the above-noted preferred embodiments, various alterations and modifications are comprehended within the scope of the appendant claims. Some of these have been discussed above, and others will be apparent to those skilled in the art.

What is claimed is:

1. A ridge ventilator for covering an open ridge of a roof while promoting ventilation of a space beneath the roof, the ridge ventilator comprising:

a sectional body having a first side and a second side, a plurality of partitions extending across said body between said sides, and a first end and a second end;

a width between said sides to permit said body to be laid over and cover said open ridge in said roof;

a recessed middle portion in a top of said body, between said sides, said recess being sized and shaped to accommodate roofing shingles;

opposed raised and curved, in side view, air foil side sections; said air foil side sections including a grill to permit air to pass therethrough between said space beneath said roof and the outside, said air foil side sections being sized and shaped to create, in a wind passing over said air foil sections, a low pressure adjacent to said grill to facilitate drawing air out of said space.

2. A ridge ventilator for covering an open ridge of a roof as claimed in claim 1, said partitions include at least two gaps to facilitate the bending of said body over said ridge.

3. A ridge ventilator for covering an open ridge of a roof as claimed in claim 2 wherein said two gaps are aligned in adjacent partitions to permit said vent to fold along two bending axes on opposite sides of a peak of said ridge.

4. A ridge ventilator for covering an open ridge of a roof as claimed in claim 3 wherein said two gaps are closely spaced about a middle of said ventilator.

5. A ridge ventilator for covering an open ridge of a roof as claimed in claim 1 wherein said recessed middle portion includes a generally flat web.

6. A ridge ventilator for covering an open ridge of a roof as claimed in claim 5 wherein said flat web includes two score lines to facilitate bending said webs along said bending axes.

7. A ridge ventilator for covering an open ridge of a roof as claimed in claim 6 wherein said flat web includes material saving openings formed therein.

8. A ridge ventilator for covering an open ridge of a roof as claimed in claim 1 wherein said flat web has extending from an underside a plurality of column supports.

9. A ridge ventilator for covering an open ridge of a roof as claimed in claim 8 wherein said plurality of column supports are sinuous to provide additional strength.

10. A ridge ventilator for covering an open ridge of a roof as claimed in claim 8 wherein said plurality of column supports are spread apart to permit air flow therebetween.

11. A ridge ventilator for covering an open ridge of a roof as claimed in claim 1 wherein said curved air foil sections include drainage openings along a side edge thereof.

12. A ridge ventilator for covering an open ridge of a roof as claimed in claim 11 wherein said air foil sections include water deflecting baffles to restrict the inflow of water through said drainage openings.

13. A ridge ventilator for covering an open ridge of a roof as claimed in claim 1 wherein said grill includes slats angled to direct precipitation downwardly.

14. A ridge ventilator for covering an open ridge of a roof as claimed in claim 1 wherein said recessed middle portion includes preformed nailing supports.

15. A ridge ventilator for covering an open ridge of a roof as claimed in claim 1 wherein said flexible partitions include offset portions adjacent to each gap to permit adjacent portions of said flexible partitions to overlap at said gap, when said ventilator is bent over a ridge, to form a substantially continuous wall.

16. A ridge ventilator for covering an open ridge of a roof as claimed in claim 1 wherein said ventilator includes means for attaching said ventilator to an adjacent ventilator to create a continuous span along said ridge opening.

17. A ridge ventilator for covering an open ridge of a roof as claimed in claim 1 wherein said air foil sections include generally upright inside walls which define said recessed middle portion, and said inside walls include weep holes to permit moisture to drain from said recessed middle portion.

* * * * *